United States Patent [19]

Wakatsuki

[11] 3,998,548

[45] Dec. 21, 1976

[54] SENSITIVE DRUM RECEIVING DEVICE FOR USE IN ELECTROPHOTOGRAPHIC REPRODUCING MACHINE

[75] Inventor: Susumu Wakatsuki, Ebina, Japan

[73] Assignee: Fuji Xerox Co., Ltd., Tokyo, Japan

[22] Filed: Aug. 7, 1975

[21] Appl. No.: 602,781

[30] Foreign Application Priority Data

Aug. 8, 1974 Japan .....94060/74

[52] U.S. Cl. ..... 355/133; 355/3 R; 355/15

[51] Int. Cl.[2] ..... G03G 15/00

[58] Field of Search ..... 355/133, 3 R, 3 DR, 355/15, 17

[56] References Cited

UNITED STATES PATENTS

| | | | |
|---|---|---|---|
| 3,490,841 | 1/1970 | Cely et al. | 355/3 DR |
| 3,667,840 | 6/1972 | Engel et al. | 355/15 X |
| 3,736,053 | 5/1973 | Shreeve et al. | 355/3 DR |
| 3,883,242 | 5/1975 | Takahashi et al. | 355/3 DR |

FOREIGN PATENTS OR APPLICATIONS

| | | | |
|---|---|---|---|
| 2,021,409 | 11/1971 | Germany | 355/3 DR |

*Primary Examiner*—R.L. Moses
*Attorney, Agent, or Firm*—Gerald J. Ferguson, Jr.; Joseph J. Baker

[57] ABSTRACT

A sensitive drum of an electrophotographic reproducing machine, when disengaged from its driving mechanism, is received by rails provided at the opposited ends thereof and, after pulled along the rails, received and supported rotatably by rotary supporting members provided on extensions of the rails, respectively, for the purpose of cleaning of the drum.

5 Claims, 4 Drawing Figures

FIG. 1
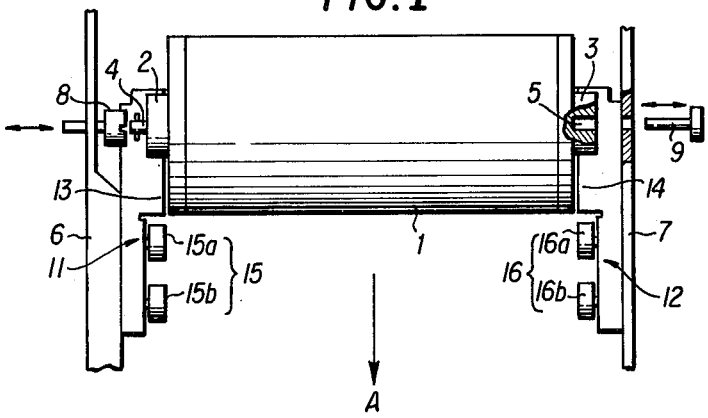
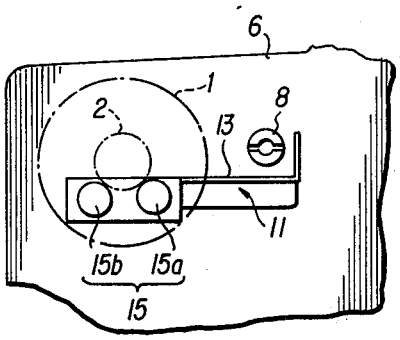
FIG. 3
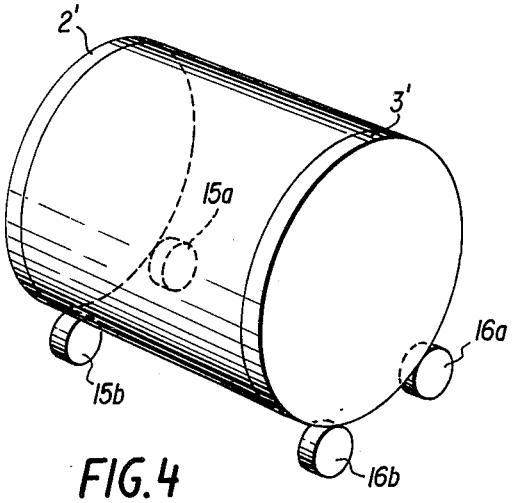
FIG. 4

SENSITIVE DRUM RECEIVING DEVICE FOR USE IN ELECTROPHOTOGRAPHIC REPRODUCING MACHINE

FIELD OF THE INVENTION

This invention relates to a sensitive drum receiving device for use in an electrophotographic reproducing machine, and more particularly to a sensitive drum receiving device, which facilitates the cleaning of a surface of the sensitive drum incorporated in an electrophotographic reproducing machine, which is to be effected periodically.

BACKGROUND OF THE INVENTION

A sensitive drum incorporated in a transfer type electrophotographic reproducing machine is mostly of the type, in which a cylindrical drum surface is applied with a photo-conductive material due to evaporation. The surface of the photoconductive material of the sensitive drum is cyclically and repeatedly subjected to the charging — exposure — developing — cleaning processes. In the cleaning process, the surface of the photoconductive material is subjected to the erasing, followed by removal of residued toner by means of a brush or web, therey being put in a re-usable condition.

The repeated use of the sensitive drum for image transfer incurs deterioration in a photoconductive materials, resulting in the lowered charging characteristic of the photoconductive material. For restoration of charging characteristic of the photoconductive material, the cleaning of surface of sensitive drum must be periodically effected by an operator.

Hitherto, the cleaning of the sensitive drum has been effected by withdrawing the sensitive drum outside of the reproducing machine. This is accompanied by the lowered workability in the cleaning as well as by a risk of breaking the surface of sensitive drum when the sensitive drum is demounted from or set to the reproducing machine.

SUMMARY OF THE INVENTION

It is accordingly an object of the present invention to provide a sensitive drum receiving device, which promotes the working efficiency in the cleaning of a sensitive drum, without a risk of damaging the surface of sensitive drum.

This object is achieved by making the cleaning of the drum surface possible without the necessity of the complete removal thereof from the reproducing machine. According to the present invention, the sensitive drum, when disengaged from its driving mechanism, is received on rails provided at the opposite ends thereof and pulled outwardly along the rails. On the extensions of the rails, rotary supporting members are provided on which the opposite end portions of the drum are rotatably supported.

Other objects and features of the present invention will become apparent from reading the descriptions which will hereunder be given to embodiments of the present invention with reference to the accompanying drawings.

BRIEF DESCRIPTION OF THE DRAWING

FIG. 1 is a fragmentary plan view of an embodiment of the present invention;

FIG. 3 is a cross-sectional view taken along the line III — III of FIG. 2, for explanatory purpose; and FIG. 4 is a perspective view, showing the outline of another embodiment of the present invention.

DESCRIPTION OF THE PREFERRED EMBODIMENTS

Figure 2:
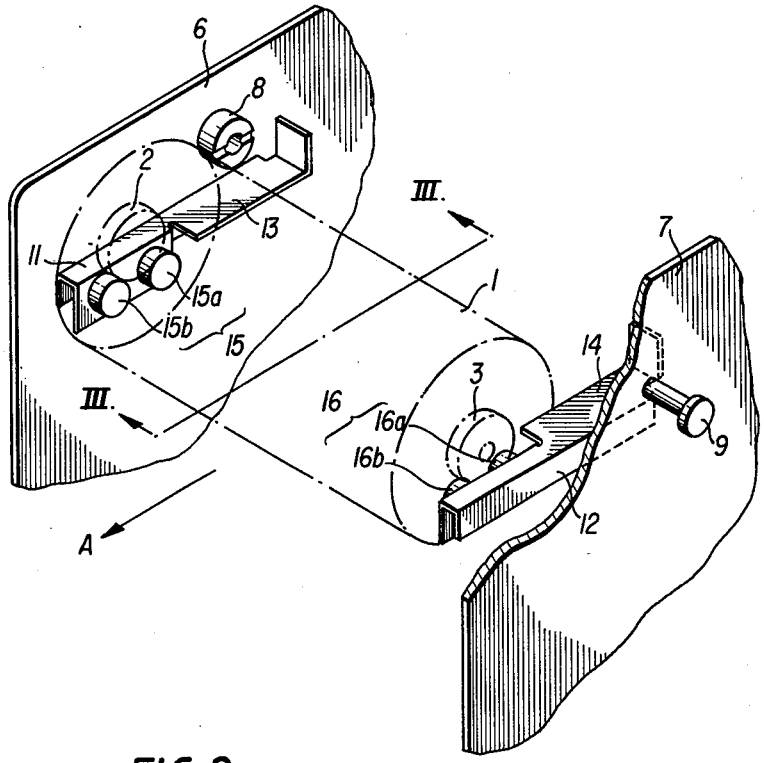
FIG. 2 is a fragmentary perspective view of the embodiment in FIG. 1, showing the outline of the sensitive drum receiving devices and the sensitive drum.

As shown in FIG. 1, tubular flanges 2 and 3 provided on the opposite sides of sensitive drum 1 coaxially and integrally therewith. A bearing pin 4 projects from one flange 2, while a bearing hole 5 is provided in the other flange 3. Supported on opposite side frames 6 and 7 are a coupling 8 and a support pin 9 which are engageable and with the flanges 2 and 3 of the sensitive drum 1 for transmitting driving power from a driving mechanism (not shown) through the frames 6 and 7 to the sensitive drum, the coupling 8 and support pin 9 being movable in the axial directions of the sensitive drum 1. The aforesaid bearing pin 4 is rotatably supported by the coupling 8. That is, the bearing pin 4 is provided with a vertical coupling pin which is received in a complimentary groove on a head portion of the coupling 8 when engaged, to form a mechanical joint. The support pin 9 is rotatably journaled in the bearing hole 5 when the electrophotographic reproducing machine is in normal operation.

Sensitive drum receiving members 11 and 12 each having an L shape in cross section are provided under respective opposite side flanges 2 and 3 of sensitive drum 1 by securing one side walls of them to the frames 6 and 7, respectively so that, when the engagement between the drum 1 and the supporting means 8 and 9 is released, the flanges 2 and 3 of the drum 1 ride on the other side walls 13 and 14 of the members 11 and 12, respectively. In detail, the sensitive drum receiving devices 11 and 12 are disposed in facing relation to each other under the flanges 2 and 3. In the normal, operative state of the drum, a small gap is left between the other side wall and the flange so that the side walls 13 and 14 do not interfere the rotation of the drum in its normal operation. An end portion of each of the sensitive drum receiving devices is bent downwardly, as shown in FIG. 2, to provide a space for the purpose to be described.

The sensitive drum receiving device 11 and 12 are placed horizontally and perpendicularly with respect to the axis of the sensitive drum 1 and the side walls 13 and 14 thereof constitute rail portions for guiding the drum. Rotary supporting portions 15 and 16 are provided in the end portions of the rails 13 and 14 which are remote from the normal position of the drum.

Each of the supporting portions 15 and 16 comprises a pair of rollers. For the supporting position 15, it comprises rollers 15*a* and 15*b* rotatably supported by the bent end portion of the device 11 in the same horizontal level such that the outer peripheries of the rollers 15*a* and 15*b* align the surface level of the rail 13 and can smoothly and stationarily carry the flange 2 of the drum 1 when the latter reaches thereat as shown in FIG. 3. A distance between the sensitive drum receiving device 11 and 12 should be wider than a width of the sensitive drum 1 but should be within a range that opposite side flanges 2 and 3 are to be placed on the rail portions 13, 14 and the rotary supporting portions 15, 16. The rotary supporting portions 15, 16 each consist of a pair of rollers 15*a*, 15*b* or 16*a*, 16*b*, each pair of rollers being attached to the sensitive drum receiving device, with a small spacing left between two rollers. The top of two pairs of rollers 15*a*, 15*b* and 16*a*, 16*b* are aligned with the plane of rail portions 13 and 14.

In operation, if the coupling 8 and support pin 9 on which the sensitive drum 1 is journaled are manually shifting to release the sensitive drum 1 from the supported condition, then the sensitive drum 1 is placed on the sensitive drum receiving devices 11 and 12, with its flanges 2 and 3 located on the rail portions 13 and 14. Subsequently, an operator rotates the sensitive drum 1 through the intermediary of the flanges 2 and 3 along the rail portions 13 and 14 towards the rotary supporting portions 15 and 16.

FIGS. 2 and 3 show the condition of the sensitive drum 1 placed on the rotary supporting portions 15 and 16 through the intermediary of flanges 2 and 3. By virtue of the rotation of two pairs of rollers 15*a*, 15*b* and 16*a*, 16*b* of rotary supporting portions 15 and 16, the sensitive drum 1 may be freely and easily rotated, whereby an operator effects the cleaning of the surface of the sensitive drum. After completion of the cleaning, the sensitive drum 1 is urged from the rotary supporting portions 15 and 16 to the rail portions 13 and 14 until the axis of sensitive drum 1 is aligned with the axially supporting portion of frames 6 and 7, and then the coupling 8 and support pin 9 are attached to the sensitive drum 1, with the former engaging the bearing pin 4 and the latter engaging the bearing hole 5. Thus, the sensitive drum 1 is set in place for subjecting to a subsequent transfer process.

In the embodiment described, the flanges 2 and 3 project from the opposite sides of sensitive drum 1 coaxially therewith and have a diameter smaller than that of the sensitive drum 1. The embodiment has no limitative sense but it is included within the scope of the invention that the opposite circumferences 2' and 3' of the sensitive drum 1 to which no photoconductive material is applied are utilized as a flange.

According to the present invention, the sensitive drum receiving devices for use in an electrophotographic reproducing machine are disposed under the flanges 2 and 3 of the sensitive drum 1 and comprise rail portions 13 and 14 and the rotary supporting portions 15 and 16 continuous to the rail portions 13 and 14. The sensitive drum receiving devices contrubute to relieving labor in the cleaning of the sensitive drum to a greater extent, as well as eliminating a laborious work of withdrawing the sensitive drum 1 outside of the reproducing machine, with the freedom from a risk of damaging the sensitive drum 1. The sensitive drum receiving devices of the present invention may be available for checking damage or break on the surface of sensitive drum 1.

It should be noted that, while only two embodiments have been described in detail, the present invention is not limited to them and many modifications may be obvious for those skilled in the art. The scope of the present invention is defined only by the appended claims.

What is claimed is:

1. A sensitive drum receiving device located in the housing of an electrophotographic reproducing machine, comprising (a) rail means, (b) a driving mechanism disposed above said rail means and releaseably connected to the sensitive drum for driving the drum, said rail means receiving and guiding opposite end portions of the sensitive drum when the latter is released from said driving mechanism and (c) rotary supporting means so disposed with respect to said rail means that said sensitive drum may be rolled from said rail means onto said rotary supporting means to rotatably support the sensitive drum for maintenance thereof.

2. A sensitive drum receiving device according to claim 1, wherein said rail means comprises a pair of oppositely disposed plate members and wherein said rotary supporting means are aligned with said plate members.

3. A sensitive drum receiving device according to claim 2, wherein each of said plate members has an end portion forming a space for setting said rotary supporting means.

4. A sensitive drum receiving device according to claim 3, wherein said rotary supporting means comprises two sets of rollers, each roller set including a pair of rollers rotatably supported in said space in an alignment with said rail.

5. A sensitive drum receiving device according to claim 1, wherein the sensitive drum is provided with reduced portions on the opposite ends thereof, said reduced portions being adapted to ride on said rail means and hence said rotary supporting means.

* * * * *